US010277984B2

(12) United States Patent
Liao

(10) Patent No.: US 10,277,984 B2
(45) Date of Patent: Apr. 30, 2019

(54) MULTI-STRAND INDEPENDENT INPUT-OUTPUT VOICE COIL

(71) Applicant: Dongguan Li Yin Technology Limited, Dongguan, Guangdong (CN)

(72) Inventor: Huangtung Liao, Guangdong (CN)

(73) Assignee: Dongguan Li Yin Technology Limited, Dongguan (CN)

( * ) Notice: Subject to any disclaimer, the term of this patent is extended or adjusted under 35 U.S.C. 154(b) by 29 days.

(21) Appl. No.: 15/588,685

(22) Filed: May 7, 2017

(65) Prior Publication Data

US 2017/0366901 A1 Dec. 21, 2017

Related U.S. Application Data

(63) Continuation of application No. PCT/CN2017/080903, filed on Apr. 18, 2017.

(30) Foreign Application Priority Data

Jun. 21, 2016 (CN) ..... 2016 1 0445250
Jun. 21, 2016 (CN) ..... 2016 1 0445302

(51) Int. Cl.

| | |
|---|---|
| ***H04R 9/04*** | (2006.01) |
| ***H04R 31/00*** | (2006.01) |
| ***H04R 9/06*** | (2006.01) |
| *H04R 1/24* | (2006.01) |

(52) U.S. Cl.

CPC ..... *H04R 9/046* (2013.01); *H04R 9/06* (2013.01); *H04R 31/00* (2013.01); *H04R 1/24* (2013.01); *H04R 2209/041* (2013.01); *H04R 2499/11* (2013.01); *H04R 2499/15* (2013.01)

(58) Field of Classification Search

CPC ..... H04R 9/046; H04R 2209/041
USPC ..... 381/402, 410, 401
See application file for complete search history.

(56) References Cited

U.S. PATENT DOCUMENTS 1,868,607 A * 7/1932 Kolster ..... H04R 1/24 381/402
2,007,747 A * 7/1935 Ringel ..... H04R 7/122 181/165
2,007,748 A * 7/1935 Olson ..... H04R 1/24 181/174
3,350,030 A * 10/1967 Green ..... B65H 75/18 138/141

(Continued)

*Primary Examiner* — Curtis A Kuntz
*Assistant Examiner* — Ryan Robinson

(57) ABSTRACT

Disclosed is a multi-strand independent input-output voice coil. The voice coil is a potted coil, which is formed by winding in the following steps: a. forming a multi-strand flat cable by synchronizing and juxtaposing at least two enameled wires; b. winding the multi-strand flat cable to form the potted coil, each enameled wire including independent current input and output ends; and c. under the control of an ICE chip, forming, by the enameled wires together, a multiple-input multiple-output electrical connection end to correspond to vibration drive control of sounds at different frequencies separately. During use, the independent current input and output ends of the enameled wires reduce impact of inertia in vibration of a vibrating diaphragm and impact of a frequency and current on a sound during a change in a volume or tone. Quality of a sound made by the loudspeaker is notably improved.

8 Claims, 5 Drawing Sheets

(56) References Cited

U.S. PATENT DOCUMENTS

| | | | | | |
|---|---|---|---|---|---|
| 4,300,022 | A * | 11/1981 | Hastings-James | H04R 9/04 | 381/121 |
| 4,413,162 | A * | 11/1983 | Lumsden | H04R 9/046 | 381/409 |
| 6,243,472 | B1 * | 6/2001 | Bilan | H04R 1/06 | 29/594 |
| 7,729,503 | B2 * | 6/2010 | Young | H04R 9/022 | 381/407 |
| 8,374,380 | B2 * | 2/2013 | Tang | H04R 9/046 | 381/400 |
| 9,253,577 | B2 * | 2/2016 | Fujiwara | H04R 9/046 | |
| 2005/0078848 | A1 * | 4/2005 | Hlibowicki | H03F 3/2171 | 381/401 |
| 2015/0003664 | A1 * | 1/2015 | Chang | H04R 9/046 | 381/410 |
| 2016/0142826 | A1 * | 5/2016 | Honda | H04R 9/046 | 381/378 |

* cited by examiner

MULTI-STRAND INDEPENDENT INPUT-OUTPUT VOICE COIL

CROSS REFERENCE TO RELATED APPLICATIONS

The present application is a Continuation Application of PCT application No. PCT/CN2017/080903 filed on Apr. 18, 2017, which claims the benefit of Chinese Patent Application Nos. 201610445302.9 and 201610445250.5 filed on Jun. 21, 2016. All the above are hereby incorporated by reference.

BACKGROUND

Technical Field

The present invention relates to the field of loudspeaker technologies, and in particular, to a multi-strand independent input-output voice coil used in a loudspeaker.

Related Art

As market requirements continuously grow, electronic devices, such as portable audio electronics, laptop computers, tablet computers, and mobile phones, are gradually developed in a direction toward thinning, and they are required to provide better sound quality, so that loudspeakers of the electronic devices, such as portable audio electronics, laptop computers, tablet computers, and mobile phones, need to be developed in a direction toward miniaturization, thinning, and high sound quality, and requirements on their acoustic performance are also increased. A voice coil is one of important components of a loudspeaker. When an alternating audio current flows through the voice coil, the voice coil is enabled to generate an alternating current varying with audio, and magnetic lines are cut to generate mechanical vibration, to drive a vibrating diaphragm to vibrate to make a sound.

A loudspeaker in a related technology includes a loudspeaker cavity, a vibrating membrane adhered to an interior of the loudspeaker cavity, and a voice coil that is accommodated in the loudspeaker cavity and that is adhered to the vibrating membrane. The voice coil includes a voice coil holder and a continuous voice coil wire wound on the voice coil holder. A voice coil of an existing loudspeaker is formed by winding only one enameled wire. During a sound making process, a high pitch, a middle pitch, or a low pitch is generated by driving, by means of the enameled wire, a vibrating diagram to vibrate. Consequently, during a change in a volume or a tone, a sound is affected by inertia in vibration of a vibrating diaphragm and is affected by a frequency and a current, and as a result, the sound is distorted to some extent, sound quality improvement of the loudspeaker is limited, and it is difficult to satisfy the pursuit of people for higher quality. In addition, because the existing voice coil has only one enameled wire, at a same voltage, the voice coil has low output power and high power consumption.

SUMMARY

An objective of the present invention is to provide a multi-strand independent input-output voice coil, so as to overcome defects of distortion and low sound quality of an existing loudspeaker during use, and prominently improve sound quality of a sound made by a loudspeaker during use.

To achieve the aforementioned objective, solutions of the present invention are:

A multi-strand independent input-output voice coil, controlled by an ICE chip to function, is provided where the multi-strand independent input-output voice coil is a potted coil, and the potted coil is formed by winding in the following steps:

a. forming a multi-strand flat cable by synchronizing and juxtaposing at least two enameled wires, the enameled wires being independent of and being insulated from each other;
b. winding the multi-strand flat cable to form the potted coil, each enameled wire including independent current input and output ends; and
c. under the control of the ICE chip, forming, by the enameled wires together, a multiple-input multiple-output electrical connection end to correspond to vibration drive control of sounds at different frequencies separately, where different sound frequencies are driven by coils formed by winding different enameled wires.

The multi-strand independent input-output voice coil further includes a voice coil framework, where the multi-strand flat cable is wound on the voice coil framework.

The voice coil framework is formed by binding a reinforced paper layer or/and an aluminum foil layer or/and a high-temperature tape.

The reinforced paper layer is a paper tube made of brown paper, the aluminum foil layer is an aluminum tube made of an aluminum foil sheet, and the high-temperature tape layer is a high-temperature tape tube made of a high-temperature tape sheet.

The potted coil is a circular ring-shaped coil, an elliptical coil, a rectangular coil, a square coil, an octagonal coil, a regular hexagon-shaped coil, or a racetrack-shaped coil, and the voice coil framework corresponds to a shape of the potted coil.

Wire diameters of all of the enameled wires in the potted coil are equal.

A quantity of the enameled wires in the multi-strand flat cable is two or more.

In the multi-strand independent input-output voice coil, when the potted coil is wound, the at least two enameled wires are juxtaposed to form the multi-strand flat cable, then the multi-strand flat cable is wound to form a first layer of a coil with an inner structure and an outer structure, and winding is performed in sequence, to form a multi-strand multi-layer potted coil with an inner structure and an outer structure.

After the foregoing technical solutions are used, during use, in the present invention, at least two enameled wires are synchronously wound to form a potted coil, and different enameled wires are independent of each other. Under the control of an ICE chip, the enameled wires together form a multiple-input multiple-output electrical connection end to correspond to vibration drive control of sounds at different frequencies separately, where different sound frequencies are driven by different enameled wire windings. That is, the enameled wires are used to bear different parts in a sound of a loudspeaker, thereby effectively avoiding a problem that modulated frequencies driven by different sounds and currents affect and interfere with each other on a same enameled wire, resulting in an impact on sound quality. That is, the setting of independent current input and output ends of the enameled wires reduces an impact of inertia in vibration of a vibrating diaphragm and impacts of a frequency and a current on a sound during a change in a volume or a tone.

Sound quality of a sound made by the loudspeaker is notably improved and is clearer. Further, in the present invention, a voice coil with several enameled wires, as compared with a voice coil with only one enameled wire, has lower power consumption.

DETAILED DESCRIPTION

To make an objective, technical solutions, and advantages of the present invention clearer, the present invention is further described below in detail with reference to the accompanying drawings and embodiments. It should be understood that specific embodiments described herein are only used to explain the present invention rather than limit the present invention.

Embodiment 1

Figure 1:
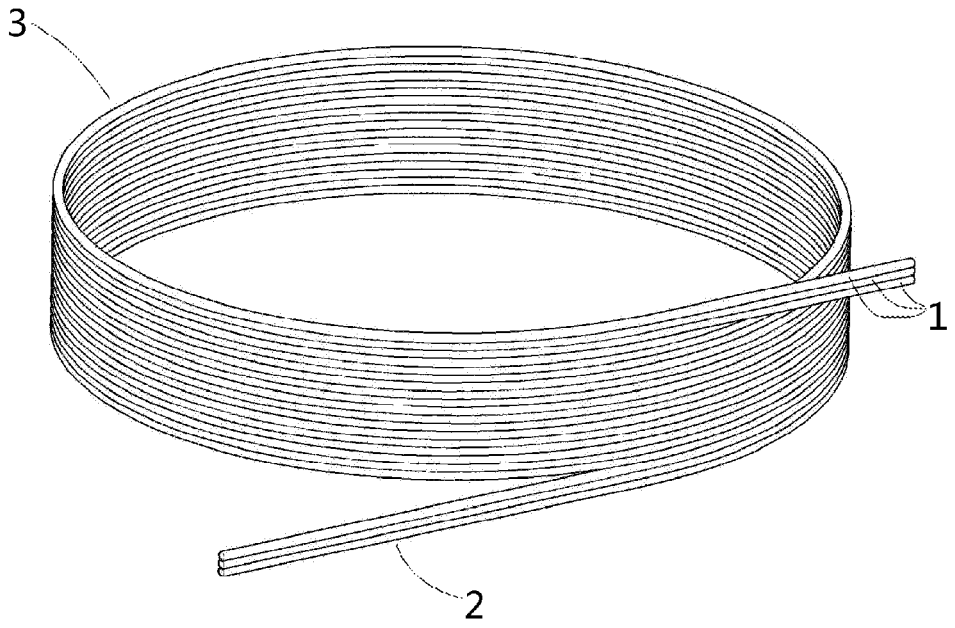
FIG. 1 is a three-dimensional schematic structural diagram of Embodiment 1 of the present invention.
Figure 2:
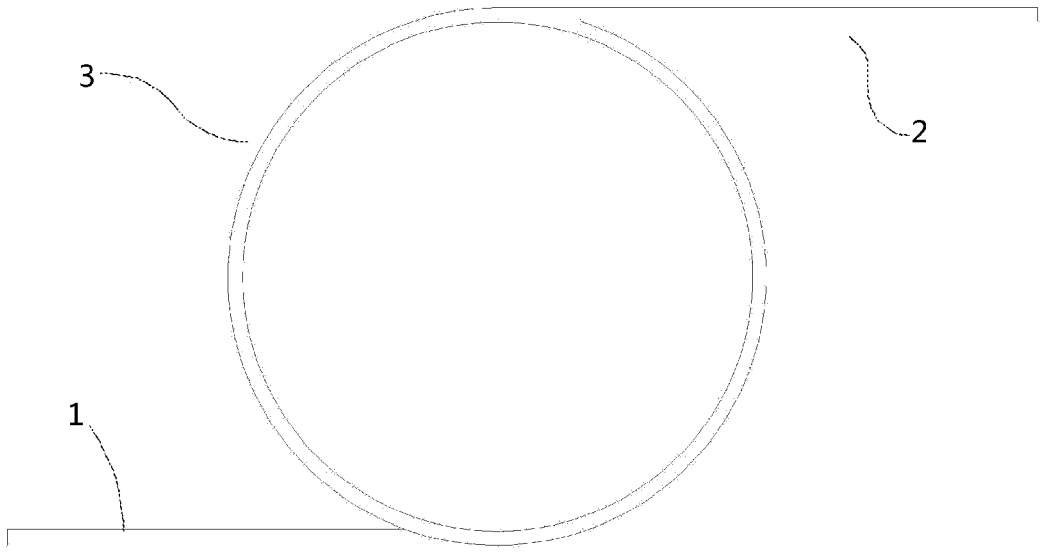
FIG. 2 is a top view of Embodiment 1 of the present invention.

Referring to FIG. 1 and FIG. 2, the present invention discloses a multi-strand independent input-output voice coil. The multi-strand independent input-output voice coil is a potted coil, and the potted coil is formed by winding in the following steps:

a. Form a multi-strand flat cable 2 by synchronizing and juxtaposing three enameled wires 1, the enameled wires 1 being independent of and being insulated from each other.

b. Wind the multi-strand flat cable formed from the three enameled wires to form a circular potted coil 3, each enameled wire of the potted coil including independent current input and output ends.

c. Under the control of an ICE chip, form, by the three enameled wires together, a three-input three-output electrical connection end to correspond to vibration drive control of a high pitch, a middle pitch, and a low pitch separately, where three sound frequencies are driven by coils formed by winding different enameled wires. An effect and an objective of lowering power consumption are achieved.

According to different installation environments and location space of loudspeakers, shapes of the loudspeakers may also be greatly different from each other. To improve a utilization rate of space within an electronic product, a loudspeaker may be designed into different shapes, such as a circular shape, an elliptic shape, a rectangular shape, or a racetrack shape, according to a requirement. A circular ring-shaped coil, an elliptical coil, a rectangular coil, or a racetrack-shaped coil is used to match loudspeakers in different shapes, and has a simple structure and wide applicability.

Certainly, alternatively, a loudspeaker may be designed into a square, a regular hexagon, and a regular octagon according to preferences of different users. A square coil, a regular hexagon-shaped coil, or a regular octagon-shaped coil is applied to a loudspeaker structure of in foregoing shape, and the loudspeaker has more various supply types and wider applicability.

In this embodiment, wire diameters of the enameled wires in the multi-strand flat cable are equal, thereby facilitating production and processing of automation equipment. Winding processing of the voice coil is more uniform and beautiful and has relatively strong practicability.

In the present invention, during use, the setting of independent current input and output ends of the enameled wires reduces an impact of inertia in vibration of a vibrating diaphragm and impacts of a frequency and a current on a sound during a change in a volume or a tone. Sound quality of a sound made by the loudspeaker is notably improved and is clearer. In addition, the loudspeaker has a good transient characteristic and high sensitivity, and is prominently improved.

Certainly, according to different using environments, people have different requirements on sound quality of a loudspeaker. For example, a requirement on sound quality of a loudspeaker used in an outdoor noisy environment is relatively low, and sound frequencies in a voice coil in the loudspeaker may merely be distinguished into two frequency bands, a high pitch and a low pitch. In this case, a requirement can be met by designing a quantity of voice coils in the loudspeaker in a manner in which a quantity of the enameled wires is two, and the voice coil has the following advantages: a relatively simple structure, low manufacturing costs, and high cost performance. Regarding a loudspeaker used in a relatively large headset, a requirement on sound quality of the loudspeaker is relatively high. Sounds of the loudspeaker may be classifies into four levels, namely, a high pitch, a secondary high pitch, a middle pitch, and a low pitch, in descending order by frequency. In this environment, by using a voice coil with four enameled wires, effects of the sound quality of the loudspeaker can be greatly improved, interference of sound signals with different modulated frequencies and currents can be reduced to a greater extent, technical effects are better, and practicability is stronger.

Embodiment 2

Figure 3:
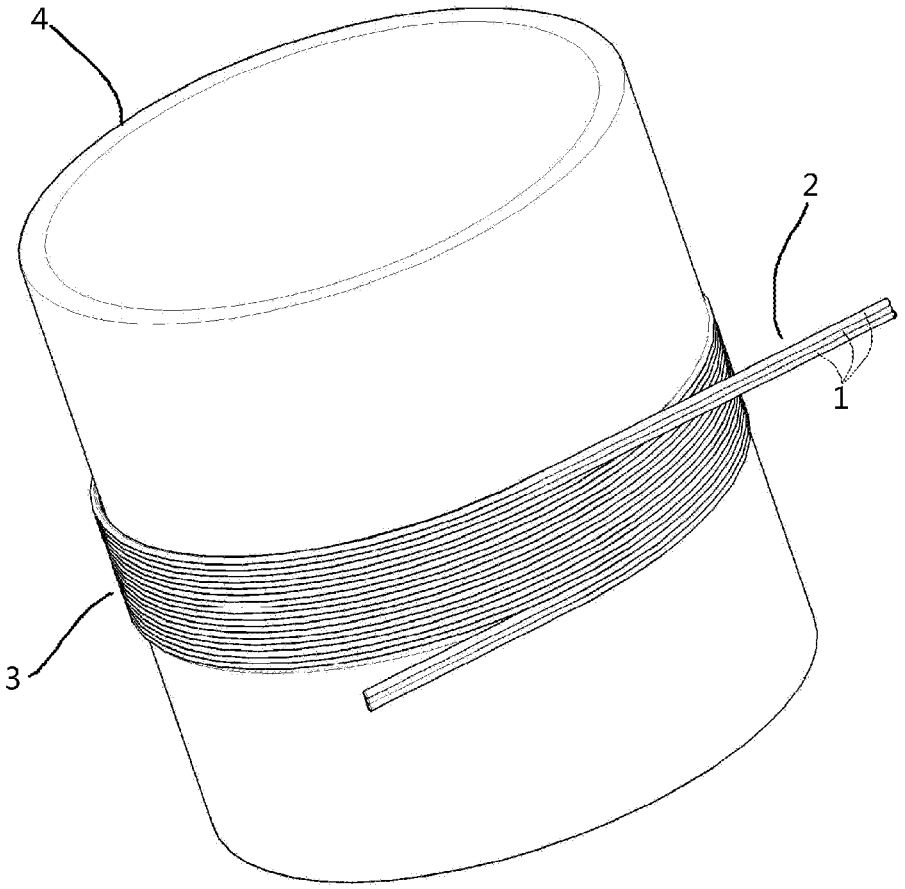
FIG. 3 is a three-dimensional schematic structural diagram of Embodiment 2 of the present invention.
Figure 4:
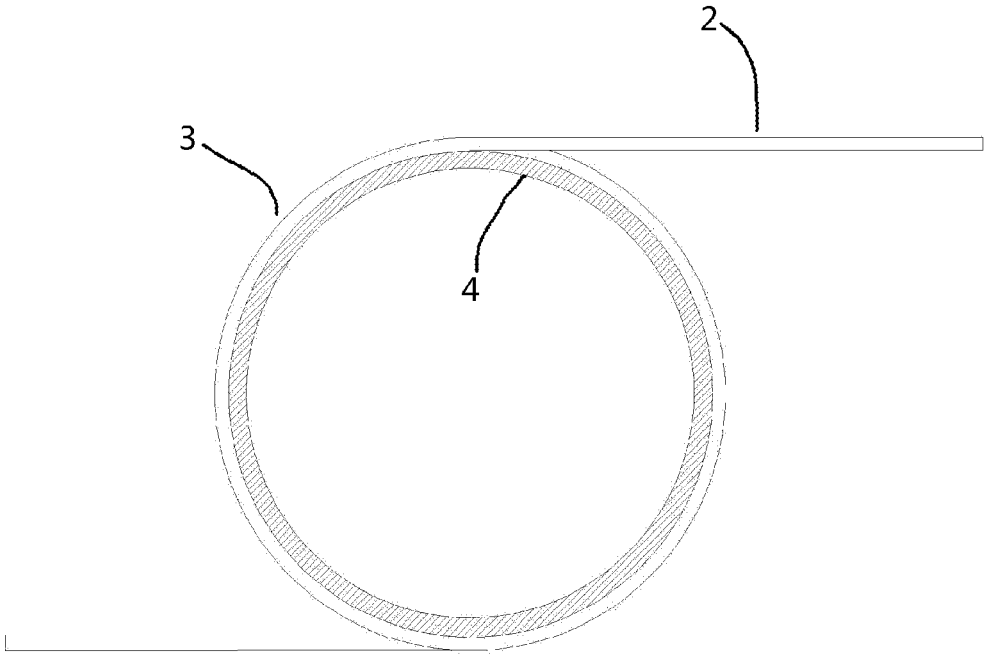
FIG. 4 is a top view of Embodiment 2 of the present invention.

Referring to FIG. 3 and FIG. 4, Embodiment 2 differs from Embodiment 1 in:

The voice coil further includes a voice coil framework 4, where the multi-strand flat cable of the potted coil 3 is wound on the voice coil framework 4, that is, an inner diameter of the potted coil 3 is equal to an outer diameter of the voice coil framework 4.

In this embodiment, the voice coil framework 4 is formed by binding a reinforced paper layer, an aluminum foil layer, or a high-temperature tape. Alternatively, the voice coil framework 4 may be formed by sequentially binding one, two, or three of a reinforced paper layer, an aluminum foil layer, and a high-temperature tape.

Preferably, the reinforced paper layer is a paper tube made of brown paper, and the aluminum foil layer is an aluminum tube made of an aluminum foil sheet.

During use, on the premise of ensuring voice coil strength, the voice coil framework 4 has the following advantages: small thickness, a small volume, and light weight, can prominently improve sensitivity of frequency bands of the loudspeaker, and has relatively strong practicability.

Embodiment 3

Figure 5:
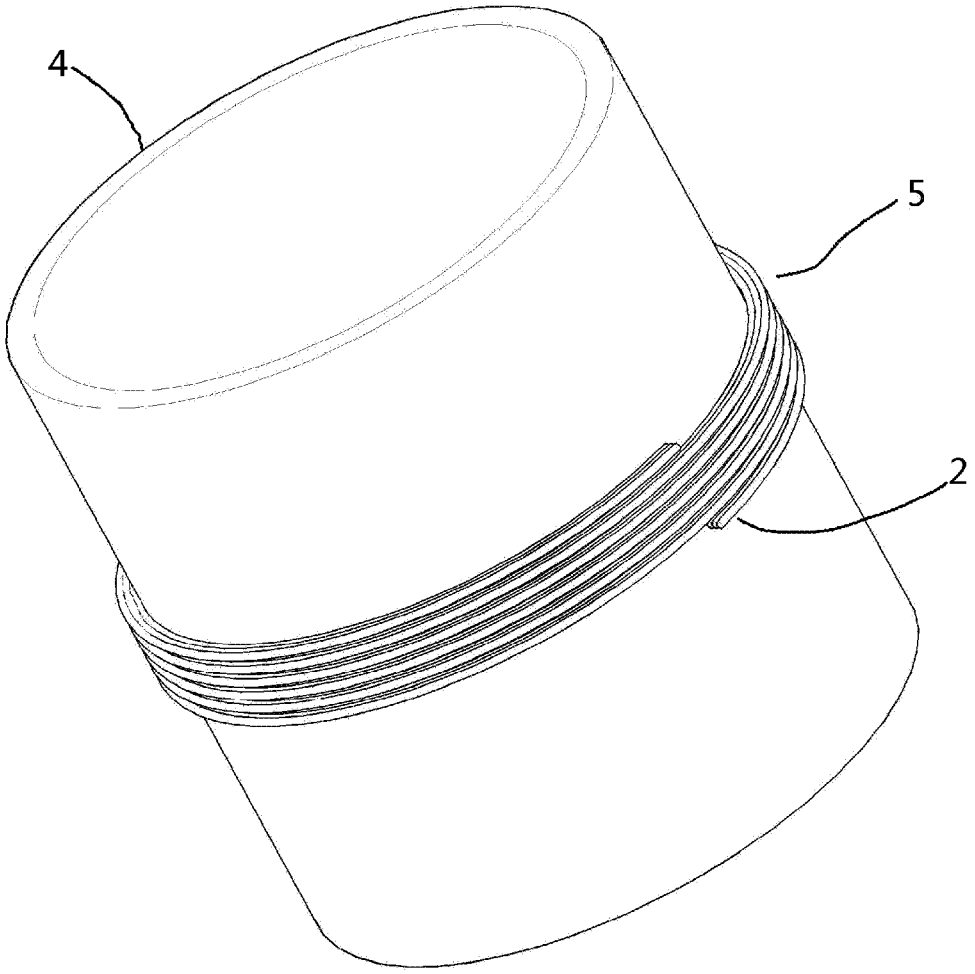
FIG. 5 is a three-dimensional schematic structural diagram of Embodiment 3 of the present invention.
Figure 6:
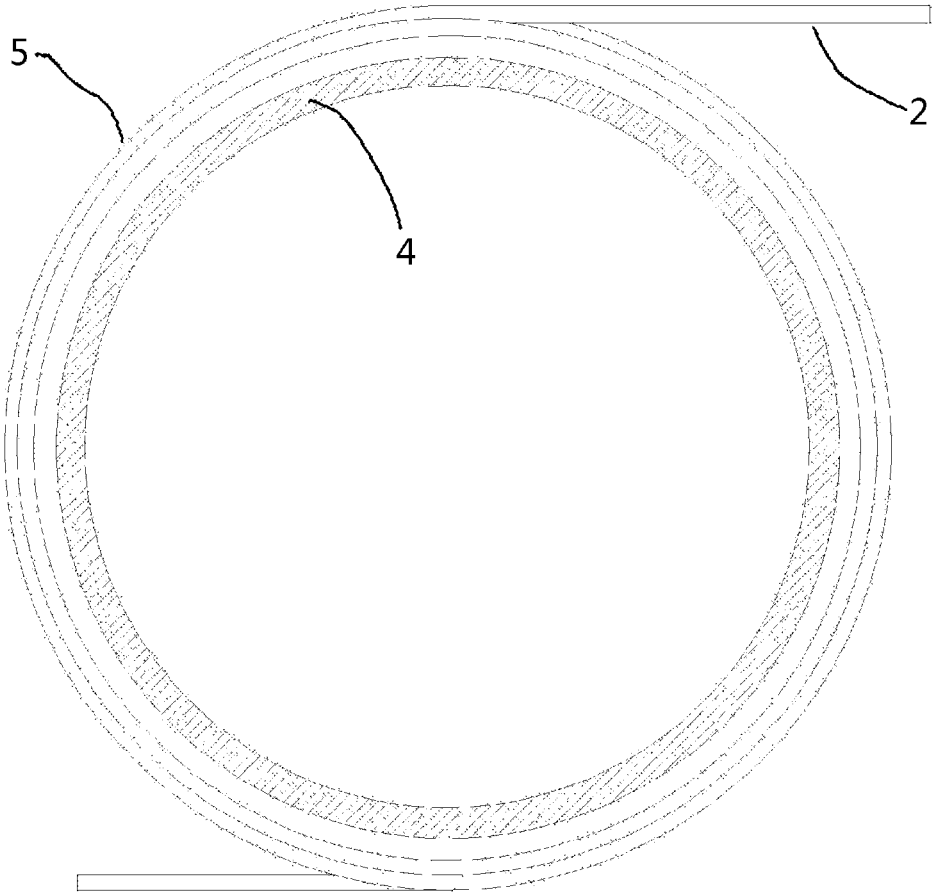
FIG. 6 is a top view of Embodiment 3 of the present invention.

Referring to FIG. 5 and FIG. 6, Embodiment 3 differs from Embodiment 2 in:

When the potted coil is wound, at least two enameled wires are juxtaposed to form the multi-strand flat cable 2. In this embodiment, three enameled wires are juxtaposed to form the multi-strand flat cable. Then the multi-strand flat cable is wound to form a first layer of a coil with an inner structure and an outer structure, and winding is performed in sequence, to form a multi-strand multi-layer potted coil 5 with an inner structure and an outer structure.

An advantage of this embodiment is that greater kinetic energy can be generated, and output power is higher when the voice coil is operating.

The foregoing descriptions are merely preferred specific implementation manners of the present invention, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure should be subject to the protection scope of the claims.

What is claimed is:

1. A multi-strand independent input-output voice coil, controlled by an In Circuit Emulator (ICE) chip to function, wherein the multi-strand independent input-output voice coil is a potted coil, and the potted coil is formed by winding in the following steps:

a. forming a multi-strand flat cable by synchronizing and juxtaposing at least two enameled wires, the enameled wires being independent of and being insulated from each other; and b. winding the multi-strand flat cable to form the potted coil, each enameled wire comprising independent current input and output ends;

wherein under the control of the ICE chip, the at least two enameled wires of the potted coil together form a multiple-input multiple-output electrical connection end to correspond to vibration drive control of sounds at different frequencies separately, wherein different sound frequencies are driven by coils formed by winding different enameled wires.

2. The multi-strand independent input-output voice coil according to claim 1, further comprising a voice coil framework, wherein the multi-strand flat cable is wound on the voice coil framework.

3. The multi-strand independent input-output voice coil according to claim 2, wherein the voice coil framework is formed by binding at least one of a reinforced paper layer, an aluminum foil layer or a high-temperature tape layer.

4. The multi-strand independent input-output voice coil according to claim 3, wherein the reinforced paper layer is a paper tube made of brown paper, the aluminum foil layer is an aluminum tube made of an aluminum foil sheet, and the high-temperature tape layer is a high-temperature tape tube made of a high-temperature tape sheet.

5. The multi-strand independent input-output voice coil according to claim 2, wherein the potted coil is a circular ring-shaped coil, an elliptical coil, a rectangular coil, a square coil, an octagonal coil, a regular hexagon-shaped coil, or a racetrack-shaped coil, and the voice coil framework corresponds to a shape of the potted coil.

6. The multi-strand independent input-output voice coil according to claim 1, wherein wire diameters of all of the enameled wires in the potted coil are equal.

7. The multi-strand independent input-output voice coil according to claim 6, wherein a quantity of the enameled wires in the multi-strand flat cable is two or more.

8. The multi-strand independent input-output voice coil according to claim 6, wherein when the potted coil is wound, the at least two enameled wires are juxtaposed to form the multi-strand flat cable, then the multi-strand flat cable is wound to form a first layer of a coil with an inner structure and an outer structure, and winding is performed in sequence, to form a multi-strand multi-layer potted coil with an inner structure and an outer structure.

* * * * *